United States Patent [19]

Redmond

[11] Patent Number: 4,611,715

[45] Date of Patent: Sep. 16, 1986

[54] DISPENSER PACKAGE

[76] Inventor: Sanford Redmond, 1385 York Ave., New York, N.Y. 10021

[21] Appl. No.: 661,564

[22] Filed: Oct. 16, 1984

[51] Int. Cl.[4] ..... B65D 75/36; B65D 75/58

[52] U.S. Cl. ..... 206/484; 222/107; 206/484.2; 206/469; 206/634

[58] Field of Search ..... 206/484, 216, 484.2, 206/469, 634; 222/94, 107

[56] References Cited

U.S. PATENT DOCUMENTS

| | | | |
|---|---|---|---|
| 3,184,121 | 5/1965 | Volckening | 206/484 |
| 3,189,227 | 6/1965 | Hobbs et al. | 206/390 |
| 3,521,805 | 7/1970 | Ward | 229/7 |
| 3,635,376 | 1/1972 | Hellstrom | 222/107 |
| 3,741,384 | 6/1973 | Cloud | 206/56 |
| 3,750,907 | 8/1973 | Steele | 222/107 |
| 3,759,371 | 9/1973 | Marks | 206/42 |
| 3,986,640 | 10/1976 | Redmond | 222/92 |
| 4,140,409 | 2/1979 | DeVries | 401/132 |
| 4,430,013 | 2/1984 | Kaufman | 401/132 |
| 4,493,574 | 1/1985 | Redmond | 222/107 |

FOREIGN PATENT DOCUMENTS 2751078 5/1979 Fed. Rep. of Germany .

*Primary Examiner*—William Price
*Assistant Examiner*—Brenda J. Ehrhardt
*Attorney, Agent, or Firm*—Morgan & Finnegan

[57] ABSTRACT

A dispenser package for flowable substances of the type where the flowable product is contained within a flexible pouch adhered to a relatively stiff sheet material which is opened along a fault line or fault pattern with one hand by folding the stiff ends toward one another into a "V" shape, wherein the flexible product-containing pouch is formed with a shallow duct or channel area directly behind the fault line connecting two laterally spaced pockets located on either side of the fault pattern to eliminate squirting or "spitting" of the flowable product upon rupture of the fault line or fault pattern. The stiff sheet material also may contain one or more protrusions displacing at least a portion of the fault line out of the plane thereof, the protrusions comprising substantially pyramidal shapes having either straight-lined or curved profiles.

10 Claims, 8 Drawing Figures

DISPENSER PACKAGE

RELATED APPLICATIONS AND PATENTS

The dispenser package structures disclosed in this application represent improvements of or improved additions to the structures disclosed in the Redmond U.S. Pat. No. 3,986,640, issued Oct. 19, 1976, and in the Redmond et al pending U.S. patent application Ser. No. 442,813, now U.S. Pat. No. 4,493,574, filed Nov. 18, 1982, the disclosures of which are hereby incorporated by reference.

BACKGROUND AND OBJECTS OF THE INVENTION

1. Field of the Invention

The present invention relates to a dispenser package for flowable products and the like and, more specifically, to certain new and useful improvements in the configuration and structure of a dispenser package which contains and dispenses a quantity of flowable product normally called for in a single use.

2. Description of the Prior Art

Various attempts have heretofore been made to provide a dispenser package into which a flowable product may be packaged in the quantity normally required for a single use, and from which such flowable material may be dispensed.

The Redmond U.S. Pat. No. 3,986,640 (hereinafter the 640 patent) discloses a dispenser package which represents a marked improvement over prior package structures in that it accomplishes efficient dispensing of a predetermined quantity of the contents with a one-handed motion and without presenting the opening difficulties previously associated with opening by removal of a cover or tearing of an envelope or pouch.

However, in the Redmond 640 patent, the flowable product is contained within a pouch formed by a flexible sheet material secured adjacent its edges to one face of a sheet of relatively stiff material. The flexible sheet material thereby defines a single pouch of essentially constant depth along the length of the relatively stiff material. Similarly, in the pending Redmond et al application Ser. No. 442,813, the flexible sheet material secured adjacent one face of the relatively stiff material defines essentially a single pouch such that a flowable product contained therein flows throughout the pouch without restriction upon application of pressure thereto.

While the structures of each of the 640 patent and application Ser. No. 442,813 have been and continue to be commercially successful, it has been found that the aforementioned pouch configurations may be substantially improved for certain uses. Thus, it has been found that for certain flowable substances, for example, catsup, upon rupture of the fault line (as in the 640 patent) or of the protrusion member displacing the fault line (as in application Ser. No. 442,813), the pressure generated by the bending motion on the flowable substance in the center of the pouch directly behind the fault line causes a small amount of material to squirt or "spit" out of the opening at the instant of rupture.

In addition, the aforementioned Redmond et al application Ser. No. 442,813, discloses, in pertinent part, the use of a protrusion member displacing at least a portion of the fault line out of the plane of the relatively stiff member which has a substantially pyramidal shape and displaces the fault line across the apex thereof. Here again, while this structure is entirely satisfactory and is applicant's preferred embodiment, it has been found that the dies necessary to produce the pyramidal shape may be difficult and expensive to manufacture.

3. Objects of the Invention

It is therefore an object of this invention to provide a new and improved dispenser package for flowable products.

A further object of this invention is to provide a new and improved dispenser package which improves prior dispenser packages in the containment of flowable products in that it eliminates squirting or "spitting" of the flowable product out of the package at the instant of rupture along the fault line.

Another object of this invention is to provide new and improved means for rupturing tough materials or combinations thereof upon their being bent into a "V" shape.

A still further object of this invention is to provide a new and improved dispenser package which improves prior dispenser packages in the containment of flowable products by providing a structure which not only greatly increases and concentrates the stress applied to the relatively stiff side to enable rupture of even relatively tough materials or laminates with a bending action developed by the use of only one hand, and which may be easily manufactured in high speed, low cost quantities.

Objects and advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, arrangements, combinations, steps and improvements herein shown and described.

SUMMARY OF THE INVENTION

Briefly described, the present invention is directed to a new and improved dispenser package for flowable products which may be opened by one hand in a manner to cause controlled rupturing of all sorts of packaging materials, ranging from low cost, easily broken materials such as polystyrene to tough, high barrier packaging materials, without squirting or "spitting" of the contents at the instant of rupture.

In accordance with a preferred embodiment of the present invention, the dispenser package comprises a relatively stiff flat sheet constructed of a tough, high barrier material or a laminate including at least one tough, high barrier layer secured to at least one surface thereof, a flexible sheet secured to one side of the relatively stiff sheet to form an enclosed pouch adjacent the relatively stiff side, a cut pattern or fault line or other fault area scored or otherwise formed in the relatively stiff sheet generally along the transverse center line thereof, the aforesaid pouch further being formed so as to contain two laterally spaced apart, relatively enlarged pockets, located on either side of the fault area, connected by a shallow duct or channel area located directly behind and extending substantially the entire length of the fault area, and at least one protrusion displacing at least a portion of the fault area out of the plane of the relatively stiff sheet, said protrusion preferably comprising an elongated substantially pyramidal shape. Advantageously, the lines of the substantially pyramidal shape may be slightly bowed or arcuate, such as to resemble an upside-down double-ended boat which has a vertical cross-section in the shape of a Gothic arch.

As used herein, the terms "fault line" or "fault pattern" are intended to encompass the aforesaid alternatives of a cut pattern, a single straight line extending across a portion or all of the relatively stiff flat sheet or a fault area formed by weakening means other than by a scored continuous line.

In each of the curvilinear and straight-edged elongated substantially pyramidal shapes described, the shorter diagonal axis of the pyramid preferably is in the same line as the fault line or fault pattern.

It will be apparent from the foregoing general description that the objects of the invention specifically enumerated herein are accomplished by the invention as here embodied.

Thus, by forming the enclosed flexible pouch with a shallow duct or channel area immediately adjacent and behind the fault line connecting two enlarged, laterally spaced pockets, it has been found that upon bending of the package to rupture the fault line the flexible wall of the connecting duct initially arches against the back side of the fault line, causing the flowable product contained in the channel to be squeezed or wiped into each of the pockets prior to rupture of the fault line. Hence, at the instant of rupture of the fault line, there is substantially no product adjacent the fault line and, consequently, squirts or "spits" out of the opening are substantially eliminated. Thereafter, continued bending of the package brings the two spaced product-containing pockets into engagement with each other and the force generated therebetween enables the product to be easily forced from each of the pockets into the shallow connecting channel and out the opening formed in the fault line at a controlled rate.

In addition, it has been found that the elongated substantially pyramidal shape previously disclosed in application Ser. No. 442,813 may be more easily formed with curved or arcuate lines and yet, surprisingly, achieves sufficient stress concentration to rupture a great number of the tough barrier materials disclosed in that application. Thus, it has been found that a plunge cut utilizing a rotary milling cutter creates a female die which forms a pyramidal shape with curved lines very closely approximating the shape of a theoretically perfect pyramid, and that the resulting substantially pyramidal protrusion creates sufficient stress to rupture a great number of the aforesaid barrier materials.

It will be understood that the foregoing general description and the following detailed description as well are exemplary and explanatory of the invention but are not restrictive thereof.

The accompanying drawings, referred to herein and constituting a part hereof, illustrate preferred embodiments of the product of the present invention, and together with the description serve to explain the principles of the invention.

DESCRIPTION OF THE PREFERRED EMBODIMENTS

Figure 1:
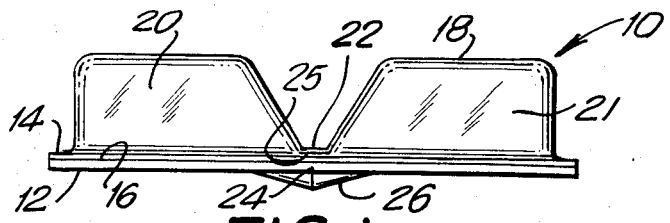
FIG. 1 is a view in side elevation of a dispenser package constructed in accordance with a preferred embodiment of the present invention in its pre-opened condition.

Referring now more particularly to FIGS. 1, 1A, 1B and 2 of the accompanying drawings, there is illustrated a first preferred embodiment of a dispenser package constructed in accordance with the present invention, indicated generally by reference numeral 10. As here embodied, package 10 includes a relatively stiff sheet 12 having a sealant/barrier layer 14 suitably bonded to the inner surface 16 of sheet 12 so that sheet 12 and the sealant/barrier layer 14 are rendered integral with one another. Also suitably integrally bonded to the outer perimeter of 12, 14 is a flexible, self-supporting sheet 18, advantageously formed by conventional means, such as vacuum forming, pressure forming, mechanical forming or combinations thereof.

All of the foregoing materials and bonds may be the same as disclosed in the aforementioned Redmond et al application Ser. No. 442,813.

In accordance with the present invention, flexible sheet 18 is preformed so that, when bonded to sheet 12, there is provided a product-containing pouch which includes a pair of laterally spaced pockets 20, 21 connected by a shallow duct or channel area 25 which is located immediately adjacent and directly behind fault line 24 scored in the outer surface of sheet 12 facing away from the enclosed pouch.

Advantageously, and as here preferably embodied, a protrusion 26 in the shape of an elongated pyramid is formed along fault line 24 so as to enable rupture of layer 14 when formed of a tough barrier material, as is disclosed in greater detail in application Ser. No. 442,813.

Figure 1A:
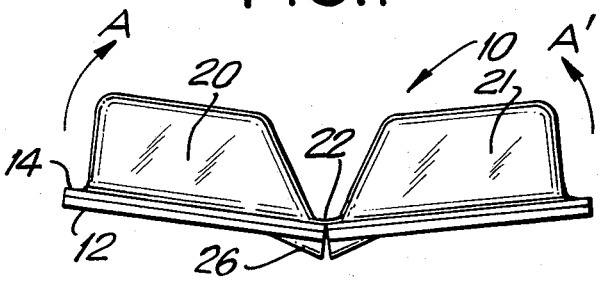
FIG. 1A is a similar view of the dispenser package of FIG. 1 in use, this view illustrating the package upon initial bending and at the moment of rupture at the fault line.
Figure 1B:
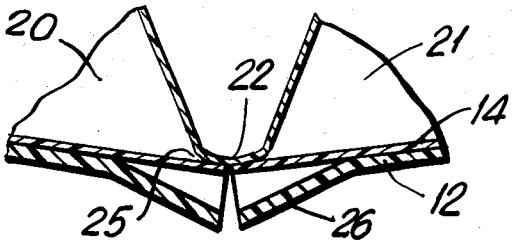
FIG. 1B is an enlarged fragmentary view of the dispenser package shown in FIG. 1A, the view illustrating the wall of the connecting channel between the spaced pockets of the product-containing pouch arched against the back side of the fault line.
Figure 2:
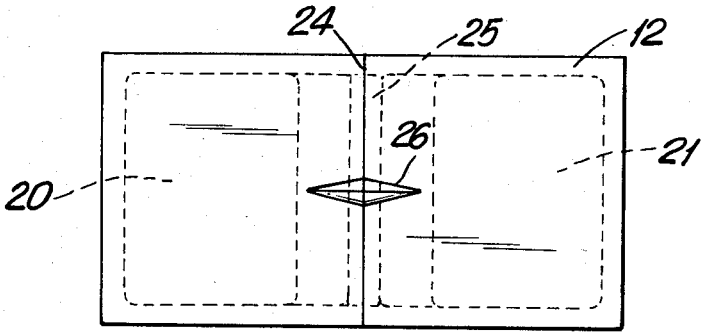
FIG. 2 is a top plan view of the dispenser package of FIG. 1.

Referring now more particularly to FIGS. 1A and 1B of the accompanying drawings, it will be seen that upon bending the ends of package 10 in the direction of arrows A, A' to rupture the fault line 24 and/or protrusion 26, the wall 22 formed in sheet 18 connecting pockets 20, 21 is initially caused to arch against the back side of fault line 24. Wall 22 thereby functions in the manner of a squeegee to squeeze or wipe the flowable product contained in channel area 25 into each of the side pockets 20, 21 prior to rupture of fault line 24 and/or protrusion 26.

It will also be seen that by spacing apart pockets 20, 21, the ends of package 10 may be bent in the direction of arrows A, A' a sufficient distance to cause rupture of fault line 24 and/or protrusion 26 prior to engagement of pockets 20, 21 and thus, at the moment of rupture no hydraulic fluid pressure is generated against fault line 24, further contributing to the prevention of spitting or squirting at the instant of rupture.

Thereafter, upon continued bending of the ends of package 10, pockets 20, 21 are brought into engagement with each other and, upon squeezing the flexible pockets together the flowable product contained therein is expelled past the shallow channel and out the fault line 24 opening and/or protrusion opening 26, as described in application Ser. No. 442,813.

Figure 3:
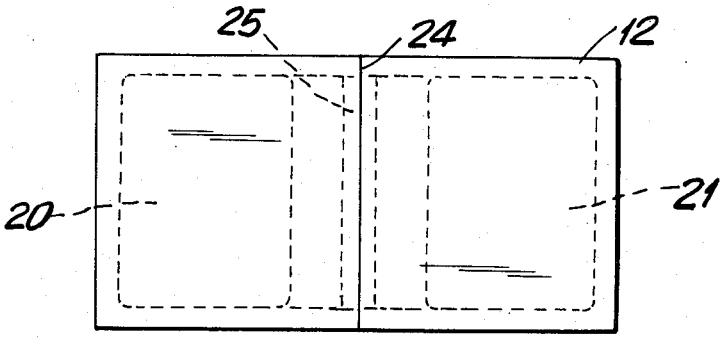
FIG. 3 is a top plan view of an alternate preferred embodiment of the invention shown in FIGS. 1 and 2.

Referring now more particularly to FIG. 3 of the accompanying drawings, it will be understood that pouch 18 as here embodied may advantageously be used with a fault line 24 or other weakened zone or cut pattern as disclosed in the Redmond 640 patent with similar results where the materials of construction do not require a stress concentration device such as protrusion 26 in order to rupture.

It will be understood from the foregoing that the flexibility of connecting wall 22 is such that the structure of the invention will operate equally satisfactorily whether wall 22 is spaced from or rests against the back side of sheet 12, 14. Thus, while sheet 18 is self-supporting and therefore may be preformed to form pockets 20, 21 and connecting wall 22, since wall 22 is not adhered to sheet 12, 14 except at its ends, it will flex under fluid pressure and thereby allow a flowable substance to pass into and through channel area 25.

Figure 4:
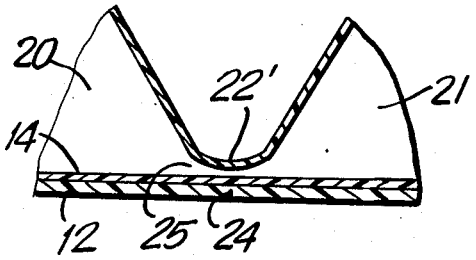
FIG. 4 is an enlarged fragmentary view of a further alternate embodiment of the invention, wherein the pouch pocket connecting wall is arcuately shaped and closely spaced from the back side of the relatively stiff sheet.

It will also be understood that, while preferred, channel wall 22 need not be generally flat and parallel to sheet 14, but may be arcuately shaped, and have its apex slightly spaced from sheet 12, 14, as illustrated at 22' in FIG. 4 of the accompanying drawings. Again, as yet a further alternative, the apex of arcuate wall 22' may be in contact with the back side of sheet 12, 14 in the pre-opened condition.

Figure 5:
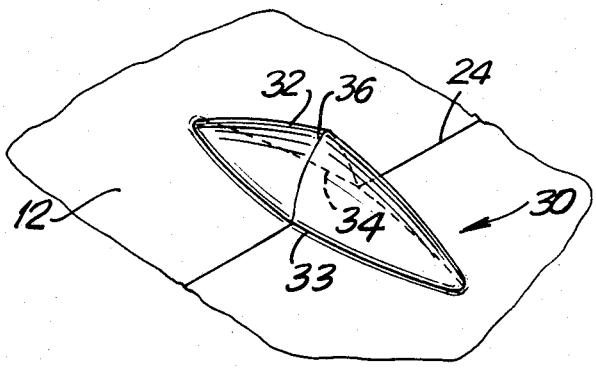
FIG. 5 is an enlarged fragmentary view in perspective illustrating an alternate embodiment of the protrusion member shown in FIG. 2, the view illustrating an elongated substantially pyramidal protrusion having curved or arcuate surfaces so as to resemble an upside-down, double-ended boat.
Figure 6:
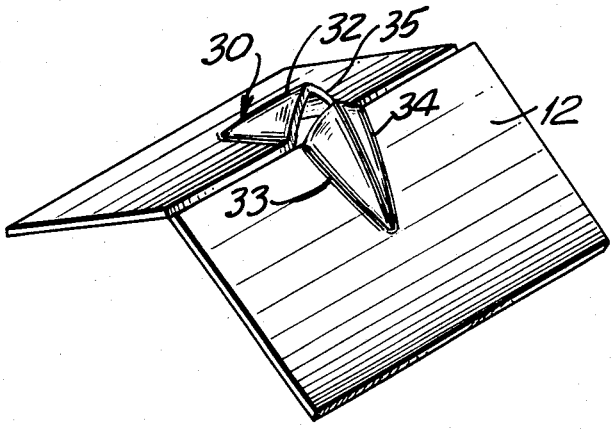
FIG. 6 is an enlarged fragmentary view in perspective illustrating the ruptured apex of the protrusion member shown in FIG. 5, and also illustrating the Gothic arch shape of a vertical cross-section taken through that member.

Referring now more particularly to FIGS. 5–6 of the accompanying drawings, there is illustrated a further alternate embodiment of the invention, wherein fault line or pattern 24 is displaced out of the plane of the relatively stiff sheet material 12 by an elongated substantially pyramidal protrusion 30, having a curved or arcuate longitudinal profile 32 and generally elliptically curved or arcuate side edges 33, 34. As best seen in FIG. 6 at 35, the vertical cross-sectional shape and transverse profile of protrusion 30 resembles a Gothic arch.

Advantageously, as shown in FIGS. 5–6, protrusion 30 displaces fault line or pattern 24 across its apex 36 substantially along its short axis. Alternatively, as discussed in greater detail and illustrated in the Redmond et al pending application Ser. No. 442,813, protrusion 30 may be positioned with its long axis extending along fault line 24, or may be formed with diagonal axes of substantially equal length.

As previously mentioned, it has been found that, although protrusion 30 is formed with slightly curved edges so as to resemble an upside-down double-ended boat, and therefore may be more easily and more economically formed than the straight-edged protrusion 26, it nevertheless, surprisingly, provides sufficient stress concentration to rupture a number of the tough plastic barrier materials disclosed in application Ser. No. 442,813.

The invention in its broader aspects is not limited to the specitic embodiments herein shown and described but departures may be made therefrom within the scope of the accompanying claims, without departing from the principles of the invention and without sacrificing its chief advantages.

What is claimed is:

1. In a dispensing package for a flowable substance, said package including a relatively stiff substantially flat sheet and a flexible sheet secured to one face of said relatively stiff substantially flat sheet, said flexible sheet forming an enclosed pouch adjacent said one face of said relatively stiff substantially flat sheet for containing a flowable substance, said relatively stiff substantially flat sheet having a fault pattern of predetermined length whereby, upon bending said relatively stiff substantially flat sheet into a "V" about an axis extending along said fault pattern so that the arms of said "V" encapture said enclosed pouch, said fault pattern ruptures to create at least one opening through which said flowable substance is dispensed, the improvement therein which comprises: said enclosed pouch having a pair of enlarged product-containing pockets spaced laterally on either side of said fault pattern and a connecting wall extending between said pockets located directly behind said fault pattern, said connecting wall forming a shallow connecting channel area adjacent the back side of said relatively stiff substantially flat sheet, whereby, upon initial bending of said relatively stiff substantially flat sheet and prior to rupture of said fault pattern, said connecting wall is caused to flex into pressing engagement with the back side of said relatively stiff substantially flat sheet to thereby force flowable product out of said channel area and into each of said pockets.

2. A dispensing package as claimed in claim 1, wherein said connecting wall is substantially parallel to and closely spaced from the back side of said relatively stiff substantially flat sheet.

3. A dispensing package as claimed in claim 1, wherein said connecting wall is arcuately shaped.

4. A dispensing package as claimed in claim 1, wherein said connecting wall extends along substantially the entire width of each of said laterally spaced pockets.

5. A dispensing package as claimed in claim 1, wherein the width of said connecting wall forming said channel area is sufficient to prevent said laterally spaced pockets from engaging one another during bending until after rupture of said fault line.

6. A dispensing package as claimed in claim 1, wherein the wall of each of said laterally spaced pockets adjoining said connecting wall slopes laterally away from said connecting channel area.

7. A dispensing package as claimed in claim 1, including protrusion means displacing at least a portion of said fault pattern out of the plane of said relatively stiff substantially flat sheet in a direction away from said one face for substantially maximally increasing the stress in said relatively stiff substantially flat sheet at the displaced portion of said fault pattern, whereby, upon said bending of said relatively stiff substantially flat sheet, said fault pattern initially ruptures at the locus of said protrusion means to create at least one opening through which said flowable substance is dispensed in a directed flow, said protrusion means having a configuration which is substantially symmetrical on either side of said fault pattern and on either side of an axis normal to said fault pattern and in which the point of greatest displacement is located substantially on said fault pattern.

8. A dispensing package as claimed in claim 3, wherein the apex of said arcuate connecting wall is closely spaced from the back side of said relatively stiff substantially flat sheet.

9. A dispensing package as claimed in claim 7, wherein said protrusion means has a peaked cross-sectional shape along said fault pattern.

10. A dispensing package as claimed in claim 7, wherein said protrusion means comprises a substantially pyramidal configuration and said fault pattern is displaced from said relatively stiff flat sheet material across the apex of said substantially pyramidal configuration.

* * * * *